US005577367A

United States Patent [19]

Abrams et al.

[11] Patent Number: 5,577,367

[45] Date of Patent: Nov. 26, 1996

[54] APPARATUS AND METHOD FOR STERILIZATION AND SECONDARY PACKAGING

[75] Inventors: Richard W. Abrams, Jacksonville, Fla.; Hiroshi Matsumoto, Saitama-Pref., Japan; Daniel T. Wang, Jacksonville; Kenneth K. Pricer, Switzerland, both of Fla.

[73] Assignee: Johnson & Johnson Vision Products, Inc., Jacksonville, Fla.

[21] Appl. No.: 431,553

[22] Filed: May 1, 1995

Related U.S. Application Data

[63] Continuation-in-part of Ser. No. 257,788, Jun. 10, 1994, Pat. No. 5,488,815.

[51] Int. Cl.[6] ..... A61L 2/00; B65B 35/30; B65B 35/56; B65B 55/12

[52] U.S. Cl. ..... 53/425; 53/411; 53/251; 53/252; 53/468; 53/502; 53/544

[58] Field of Search ..... 53/425, 426, 447, 53/448, 443, 252, 251, 250, 249, 244, 540, 544, 468, 467, 475, 473, 566, 502, 131.2, 411; 422/304, 303, 302, 300

[56] References Cited

U.S. PATENT DOCUMENTS

| | | | |
|---|---|---|---|
| 1,950,304 | 3/1934 | High | 53/425 X |
| 2,883,262 | 4/1959 | Borin | 53/425 |
| 3,606,995 | 9/1971 | Van Den Hemel | 53/425 X |
| 4,691,820 | 9/1987 | Martinez | 206/205 |
| 4,909,697 | 3/1990 | Bernard, II et al. | 53/251 X |
| 4,982,553 | 1/1991 | Itoh | 53/251 X |
| 5,122,340 | 6/1992 | Shimamura et al. | 53/425 X |
| 5,224,593 | 7/1993 | Bennett | 53/449 X |
| 5,269,216 | 12/1993 | Corominas | 53/425 X |

*Primary Examiner*—James F. Coan

[57] ABSTRACT

An apparatus for the sterilization and secondary packaging into cartons storing arrays of blister packages, each of which contains at least one hydrophilic contact lens immersed in a sterile aqueous solution. More specifically, disclosed in an apparatus adapted to provide for arrays of blister packages which are transported within trays supported on racks. These racks are transported to a sterilization chamber for sterilizing the arrays of blister packages, and from which the sterilized arrays of blister packages are then transported to a locale for implementing the pairing thereof and the secondary packaging into sealable cartons. Also disclosed is a method of sterilizing and implementing the secondary packaging into cartons of predetermined quantities of arrays of blister packages, each of which contains a hydrophilic contact lens immersed in a sterile aqueous solution, so as to provide a sterile environment for the arrays of blister packages.

42 Claims, 13 Drawing Sheets

APPARATUS AND METHOD FOR STERILIZATION AND SECONDARY PACKAGING

CROSS-REFERENCE TO THE RELATED PATENT APPLICATION

This application is a continuation-in-part application of Ser. No. 08/257,788; filed on Jun. 10, 1994 now U.S. Pat. No. 5,488,815.

BACKGROUND OF THE INVENTION

The present invention relates to an apparatus for the sterilization and secondary packaging into cartons of arrays of blister packages, each of which package contains at least one hydrophilic contact lens immersed in a sterile aqueous solution. More specifically, the invention is directed to an apparatus adapted to provide for the assembly of arrays of blister packages which are suitably transported in batches of predetermined quantities within one or more trays while positioned on suitable transport racks. These trays are transported on the racks to a sterilization chamber for sterilizing the arrays of blister packages, particularly the lens-containing interiors thereof, and from which the sterilized arrays of blister packages are then transported to a locale for implementing the secondary packaging thereof into sealable cartons. In addition to the foregoing, the invention is also directed to a method of sterilizing and implementing the secondary packaging into cartons of predetermined quantities of arrays of blister packages, each of which blister package contains a hydrophilic contact lens immersed in a sterile aqueous solution, so as to provide a sterile environment for the arrays of blister packages.

The packaging of hydrophilic contact lenses in a sterile aqueous solution is well known in the contact lens manufacturing technology. Particularly, packaging arrangements of that type generally consist of so-called blister packages adapted to be employed for the storage and dispensing of the hydrophilic contact lenses for use by a medical practitioner or a consumer who intends to wear the contact lenses. Such hydrophilic contact lenses, which may be disposable after a single period of wear or short-term use, are inexpensively manufactured from suitable hydrophilic polymeric materials; for example, copolymers of hydroxyethylene methacrylate (HEMA) containing from about 20% to 90% or more of water, depending upon the polymer composition. These contact lenses are generally stored immersed in a sterile aqueous solution, ordinarily consisting of an isotonic saline solution, in order to prevent dehydration and to maintain the lenses in a ready-to-wear condition.

A blister package of the foregoing type normally comprises a base member which is molded from a suitable injection-molded or thermoformed plastic material; for instance a polyolefin, such as polypropylene, and incorporates a cavity adapted to house the contact lens in the aqueous solution. The cavity is sealingly closed by a label-forming cover, preferably in the form of a flexible multi-layered laminated foil or suitable plastic film structure which may incorporate a silicon oxide barrier material in order to provide the so-called blister package. This type of packaging arrangement has found widespread use in view of the inherently advantageous storing properties thereof and easy-to-dispense nature of the package by simply peeling the foil from the base member enabling a user to gain ready access to the contact lens which is contained in the cavity of the base member. For example, a blister package which is adapted to provide a sterile sealed storage environment for a disposable, essentially single-use hydrophilic contact lens, which is normally worn for about 8–18 hours within any 24-hour period, wherein the lens is immersed in a sterile aqueous solution within the package is described in U.S. Pat. No. 4,691,820 to Martinez; which is assigned to the common assignee of the present application, and the disclosure of which is incorporated herein by reference.

In the above-mentioned U.S. Patent, the blister package for storing and dispensing a hydrophilic contact lens includes an injection-molded or thermoformed plastic base portion or member incorporating a molded cavity which is surrounded by an outstanding planar flange extending about the rim of the cavity. A flexible cover sheet, such as a laminated foil is adhered to the surface of the flange so as to sealingly enclose the cavity in a generally liquid-tight manner. The surface of the covering foil may constitute a label and be imparted suitable printing indicia informative of the product stored in the blister package, the name and address of the manufacturer, and also incorporate various decorative designs and logos as desired; and also provide for changeable information, such as lot numbers, fitting parameters, expiration dates and the like in addition to the foregoing, such as may be required by FDA regulations.

At this time, a novel and unique concept has been developed through a design for packaging arrangements of the blister package type, particularly for the containment of hydrophilic contact lenses in a sterile aqueous solution, wherein a plurality of base members for such blister packages, each having a cavity for containing a hydrophilic contact lens in the sterile aqueous solution, are adapted to be positioned in a contiguous array and sealingly covered by a single or unitary flexible cover sheet, the latter of which is preferably in the form of a multi-layered flexible laminate web having a foil or a plastic film incorporating a silicon oxide barrier material. In this instance, the laminated or plastic material cover sheet is provided with weakening lines, preferably in the form of perforations, extending intermediate each of the respective base members so as to enable individual segments of the foil member to be detached along the weakening lines and in conjunction with the therewith associated base member separated from the remaining array when it is desired to gain access to the contact lens contained in the separated blister package without adversely affecting the integrity of the packaging. This type of arrayed multiple interconnected blister package structure enables the compact packaging of a plurality of such arrays, each possessing a specified number of contact lens-containing base members interconnected by a single flexible cover sheet, within the confines of a suitable sealed container, such as a rigid paperboard carton. In the carton there may be compactly stored a plurality of arrays of blister packages which, under circumstances, may comprise interleaved pairs of and superimposed arrays of blister packages and wherein; for example, each array consists of five or even larger quantities of interconnected blister packages with each of the latter having a single disposable contact lens housed therein. The carton may store six superimposed arrays of blister packages, for a total of thirty contact lenses; or in effect, a 30-day supply of contact lenses for respectively one eye of a user, although it is possible to contemplate to provide for cartons storing a 5-, 10-, 15-, 20-, or 25-day supply of contact lenses, or even other quantities. A packaging arrangement for contact lenses of that type which is in the form of arrays of interconnected blister packages is disclosed in applicant's copending U.S. patent application Ser. No. 08/257,796; filed Jun. 10, 1994; entitled "Packaging Arrangement for Contact Lenses" (Attorney Docket No. 9014, VTN-0090), which is commonly assigned to the assignee of the present application and the disclosure of which is incorporated herein by reference.

The blister packages which are formed through the intermediary of this structure comprise a plurality of contiguously arranged injection-molded base members each containing a cavity for housing a hydrophilic contact lens in a sterile aqueous solution, and wherein the resultant array of such base members; for example, five (5) base members, is adapted to be sealingly covered and interconnected by a single multi-layered flexible laminated foil or web which also forms a common label, preferably of the type disclosed in applicant's copending U.S. patent application Ser. No. 08/106,386, filed Aug. 13, 1993, entitled "Method of Double-Sided Printing of a Laminate and Product Obtained Thereby" (Attorney Docket No. 9013; VTN-0098) assigned to the common assignee of the present application, and the disclosure of which is incorporated herein by reference.

In the foregoing disclosure, the multi-layered laminated foil includes an outer layer of a plastic film material, such as a polyolefin and preferably polyester, which is adhesively bonded to the surface of a supporting metallic foil, such as aluminum, although a layer of silicon oxide could be utilized instead of the metallic foil, and in which the outer layer is double-sided printed; in effect, on both opposite surfaces. The surface of the outer plastic film layer which faces towards and is adhered to the metallic foil is imprinted with suitable indicia and legends which may consist of permanent information regarding the manufacturer and the product, logos, instructive material, and decorative and advertising indicia relative the product in the blister package; whereas the opposite or exterior surface of the outer plastic film material layer may include suitable changeable information, such as expiration dates, lot numbers, fitting parameters, lens power, and other data specific to the packaged product. The interior surface of the outer plastic film material layer, when desired, may be imprinted through the intermediary of suitable lithographic printing, either in single color or multicolors and also provided with an appropriate printed background; whereas the changeable information specific to the product which is imprinted on specific areas of the outwardly facing surface of the outer film layer, may be printed thereon through thermal transfer printing, as described in detail in the above-referenced copending U.S. patent application Ser. No. 08/106,386.

SUMMARY OF THE INVENTION

In order to accomplish the foregoing sterilization of the arrays of blister packages, particularly of the product or contact lens-containing interiors thereof, and to thereafter implement their secondary packaging into sealable cartons, the inventive apparatus contemplates the utilization of a novel conveyor system in which the foregoing is achieved in an essentially automated mode of operation. Specifically, the apparatus provides for the conveyance of a system of racks each supporting a plurality of trays, each of which tray is adapted to house therein a specific quantity of arrays of blister packages, such as are disclosed in the copending U.S. patent application Ser. No. 08/257,796 (Attorney Docket No. 9014; VTN-0090), wherein the arrays of blister packages are conveyed through the intermediary of a transfer mechanism into a respective tray so as to fill spaces in the latter arranged in specified rows and columns. A plurality of such array-filled trays may be loaded into a rack by being axially shifted and vertically layered in the rack, and with the rack then conveyed along a predetermined path. A further conveyor is adapted to convey the rack containing the trays with the arrays of blister packages therein into a sterilization chamber, such as an autoclave, in which the arrays of blister packages are collectively sterilized. Subsequent to the sterilization procedure having been completed, the rack containing the trays with the sterilized arrays of blister packages is transported by a further conveyor from the sterilization chamber towards a tray unloading arrangement in which the trays are sequentially unloaded from the rack and individual trays inverted to cause the arrays of blister packages to be removed therefrom in pairs. These pairs of arrays are inverted relative to each other and interleaved so as to be sequentially transported to a secondary packaging machine for packing and sealing specified quantities of the sterilized paired arrays of blister packages into cartons. The secondary packaging machine causes the specified quantities of interleaved arrays of blister packages to be advanced in succession into a cartoner having open-ended cartons therein adapted to receive the arrays of blister packages. Thereupon, each of the filled cartons is closed and sealed in the cartoner in sequential steps and transported to further stations for suitable additional handling, such as labeling, bar coding, weighing and possible accumulation for boxing and warehousing, as may be required. The emptied trays are then reinverted and repositioned on an indexing conveyor, reloaded into an empty rack and transported therein to a return conveyor so as to be in conditions of readiness for unloading the trays, refilling the latter at the tray filling location with arrays of blister packages which are to be sterilized, and loaded into an empty rack for transport to the sterilization chamber.

Accordingly, it is an object of the present invention to provide an apparatus for the sterilizing and secondary packaging of specified quantities of arrays of blister packages, with each blister package containing a contact lens immersed in a sterile aqueous solution.

A more specific object of the present invention is to provide an apparatus of the type described in which a procedure for filling trays with specified quantities of the arrays of blister packages is implemented in an automated manner, pluralities of the filled trays transported on a rack to a sterilizing chamber, and thereafter transported to an unloading arrangement for discharging the arrays of blister packages with their sterilized contents from the racks, emptying the trays and effectuating an orientation of the arrays of blister packages and thereafter packaging specified quantities thereof into sealable cartons.

Still another object of the present invention is to provide an apparatus of the type described in which there are carried out the functions of unloading empty trays from a rack, wherein the trays are adapted to be filled with arrays of blister packages, positioning the arrays for filling into the trays, loading the filled trays into a further previously empty rack, transporting the rack with the array-filled trays into a sterilizing chamber, thereafter transporting the rack containing the trays with the sterilized arrays of blister packages to an arrangement in which individual of the trays are successively inverted to facilitate orientation and discharge of paired arrays at a rack unloading station, with the arrays of sterilized blister packages then being conveyed to a cartoner for filling cartons with the packages; while the emptied trays are rotated into their original positions, loaded into an empty rack and conveyed there towards the initial rack unloading and tray filling workstation.

Yet another object of the present invention is to provide a method of sterilizing and secondary packaging into cartons of arrays of blister packages, each containing a contact lens immersed in a sterile aqueous solution through utilizing of the apparatus as described herein.

A more specific object of the invention is to provide a method for the sterilization and secondary packaging into cartons of a plurality of arrays of blister packages in which the method is implemented through the utilization of automated conveyor and sterilization apparatus in a highly efficient and precise mode of operation.

BRIEF DESCRIPTION OF THE DRAWINGS

Reference may now be had to a preferred embodiment of the apparatus for sterilization and secondary packaging constructed pursuant to the invention, particularly as directed to the packaging of contact lenses in a sterile environment, taken in conjunction with the accompanying drawings; in which.

DETAILED DESCRIPTION

Figure 1:
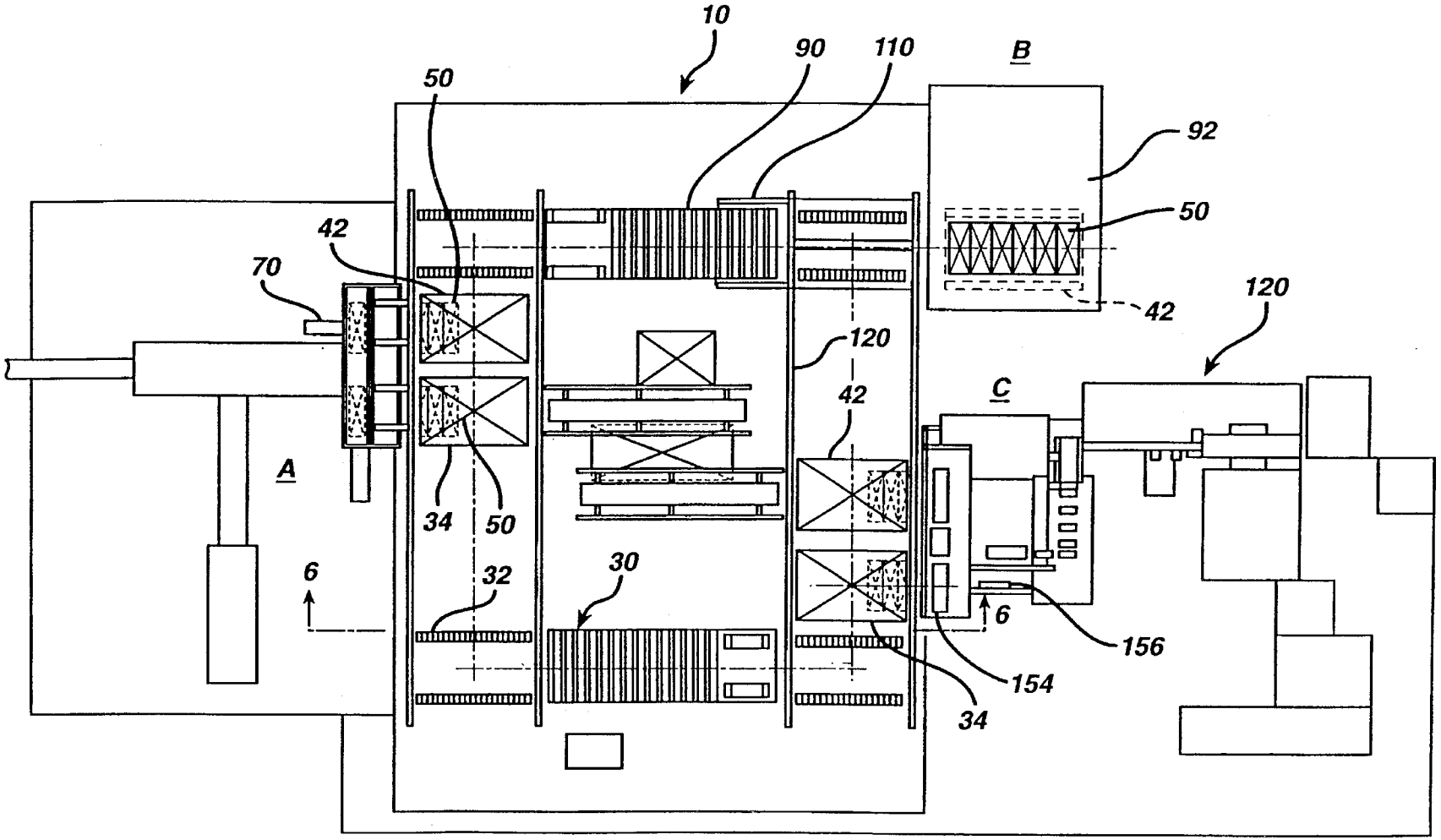
FIG. 1 is a generally diagrammatic plan view of the sterilization and packaging apparatus pursuant to the invention.

Referring now in more specific particularity to the drawings, as shown in the overall view of FIG. 1, there is disclosed a generally schematic plan view of the overall operating structure of an apparatus 10 for implementing the sterilization and secondary packaging into cartons of pluralities of superimposed paired and interleaved arrays of blister packages employed for the containment of contact lenses in a sterile environment.

As illustrated in FIG. 1, there is disclosed a conveyor system including a plurality of roller conveyors for the conveyance of racks each adapted to receive a plurality of trays containing arrays of blister packages in order to enable conveyance thereof into a sterilization unit comprising a sterilization chamber. Thereafter conveyance thereof is implemented towards a secondary packaging machine for receiving the sterilized arrays of blister packages from the trays, with the latter being unloaded from the transport racks, and for packaging predetermined quantities of arrays of blister packages into cartons in a rapid and sequential and fully automated mode of operation, as detailed hereinbelow.

Figure 2:
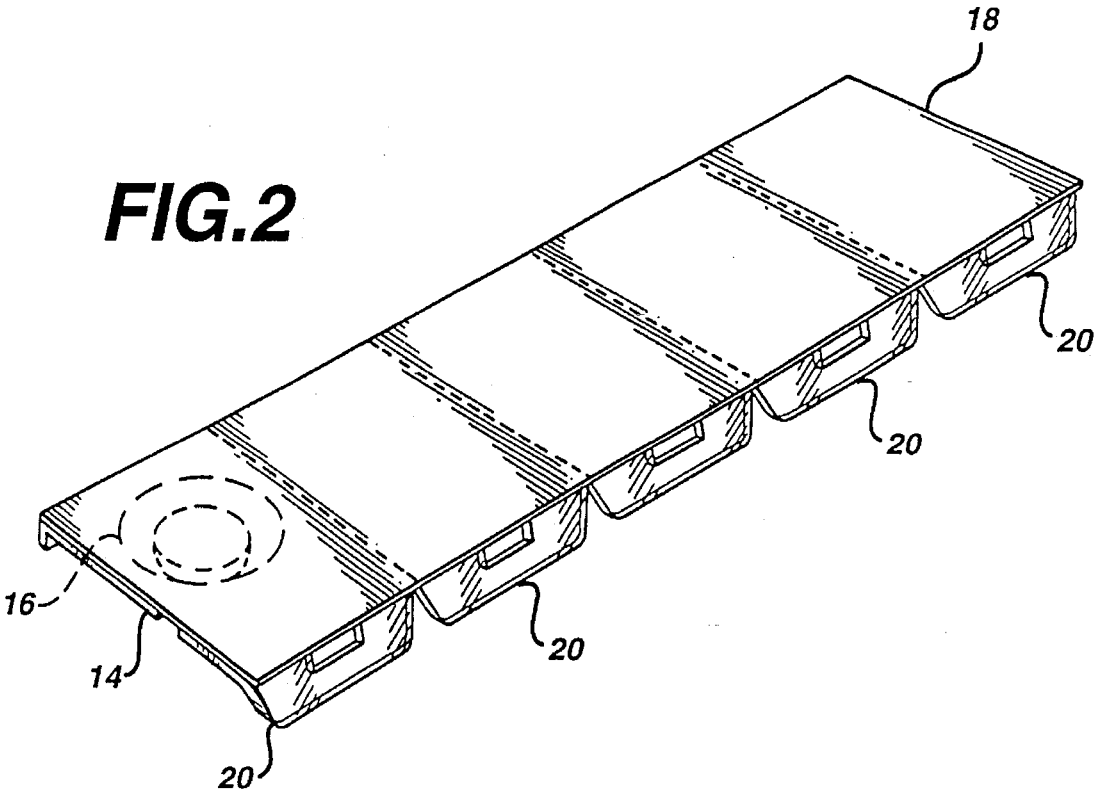
FIG. 2 is a perspective view of a typical array of interconnected blister packages.

As shown in FIG. 2 of the drawings, each array of blister packages 12 consists of five adjacently located base members 14 each possessing a cavity 16 for the containment of a contact lens immersed in a sterile aqueous solution, and with the array 12 being sealingly covered by a single printed label-forming flexible laminated cover sheet 18, so as to be separable along perforation lines into individual blister packages, each respectively containing a single contact lens.

Figure 3:
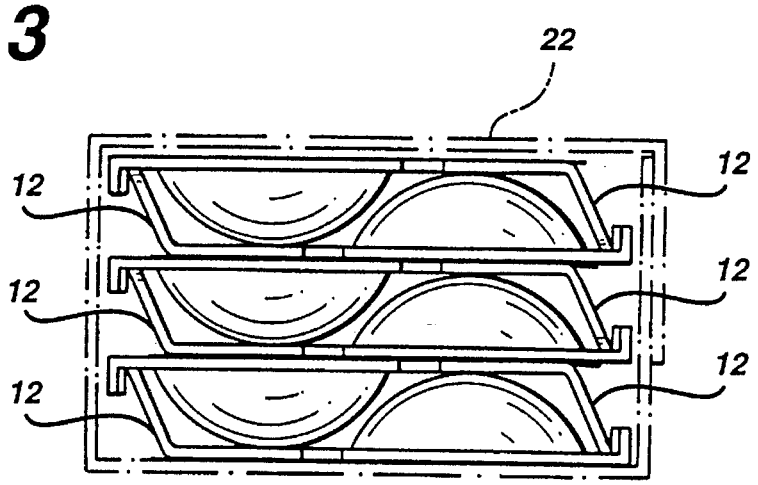
FIG. 3 is a side elevational view, in section, of a plurality of interleaved paired and superimposed arrays of blister packages, as intended to be arranged in a carton.
Figure 4:
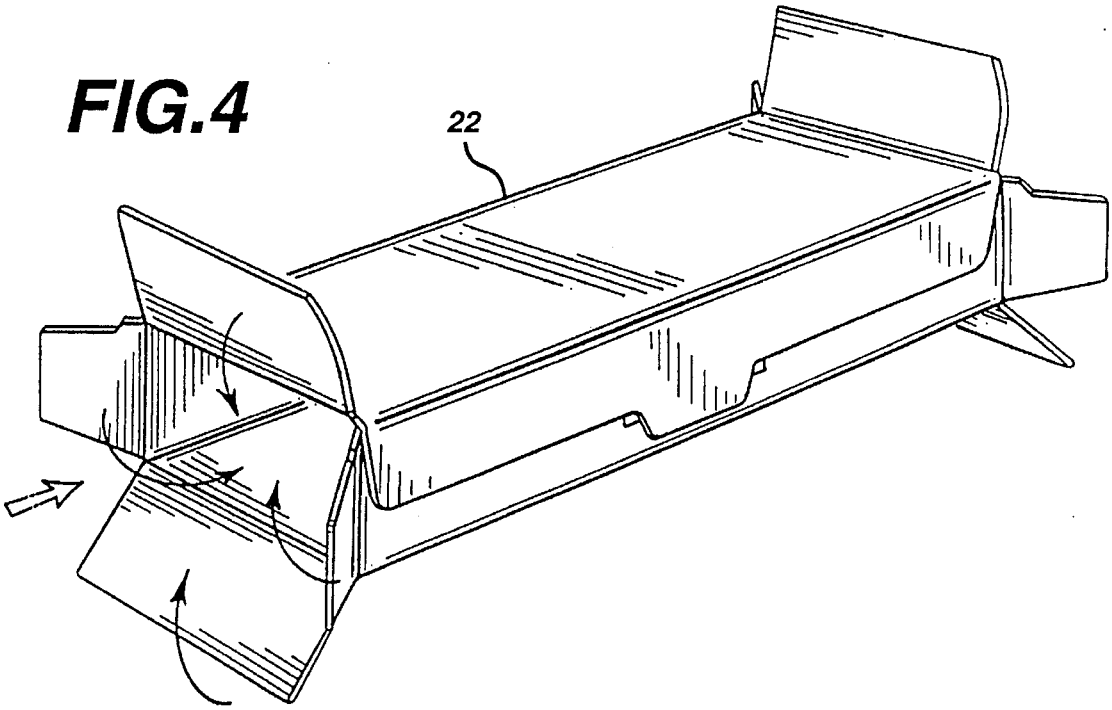
FIG. 4 is a perspective view of the carton, with the end flaps in an opened condition.

The base members 14, each of which possesses a flange 20 at one end thereof, are constructed as disclosed in copending U.S. patent application Ser. No. 08/257,796 (Attorney Docket No. 9014, VTN-0090) when positioned in a carton 22 as illustrated in FIG. 3 arranged in inverted interleaved pairs of arrays 12, shown in the drawing as consisting essentially of six arrays in this particular instance, filling a carton 22 as shown in FIG. 4 in the direction of the arrow H, whereby the end flaps of the carton are adapted to be closed in sequence to form the carton of FIG. 5. The latter is illustrated with the opening of the reclosable top flap having been effected thereof at some subsequent time so as to enable access to the individual blister packages 12 therein by a medical practitioner or user of the contact lenses.

Figure 6:
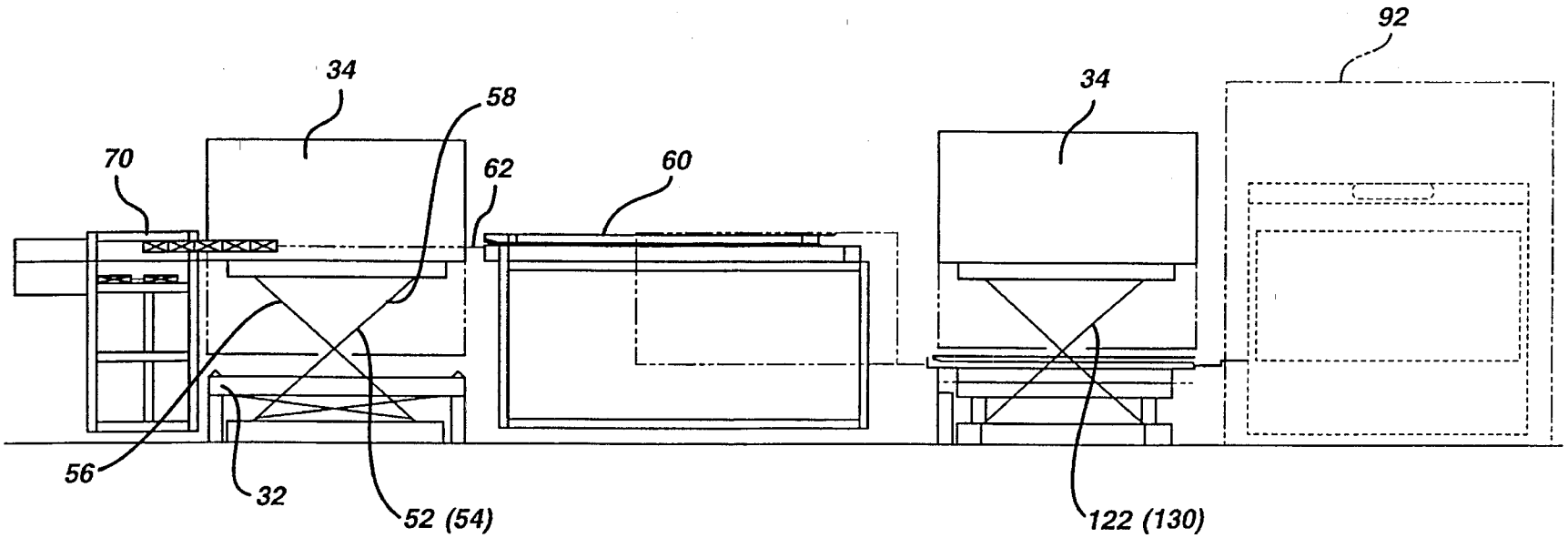
FIG. 6 is a view taken along line 6—6 in FIG. 1.
Figure 14:
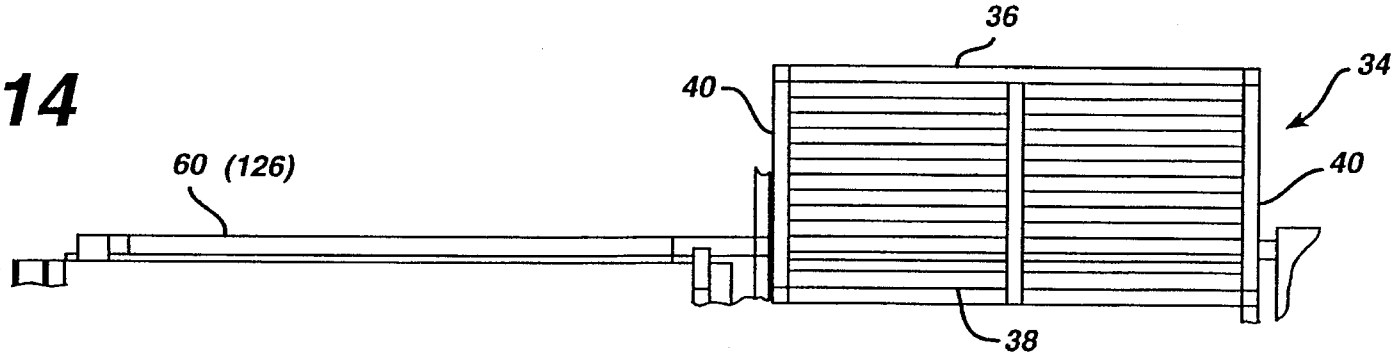
FIG. 14 is a side view of a rack unloader utilized at a tray unloading workstation.
Figure 15:
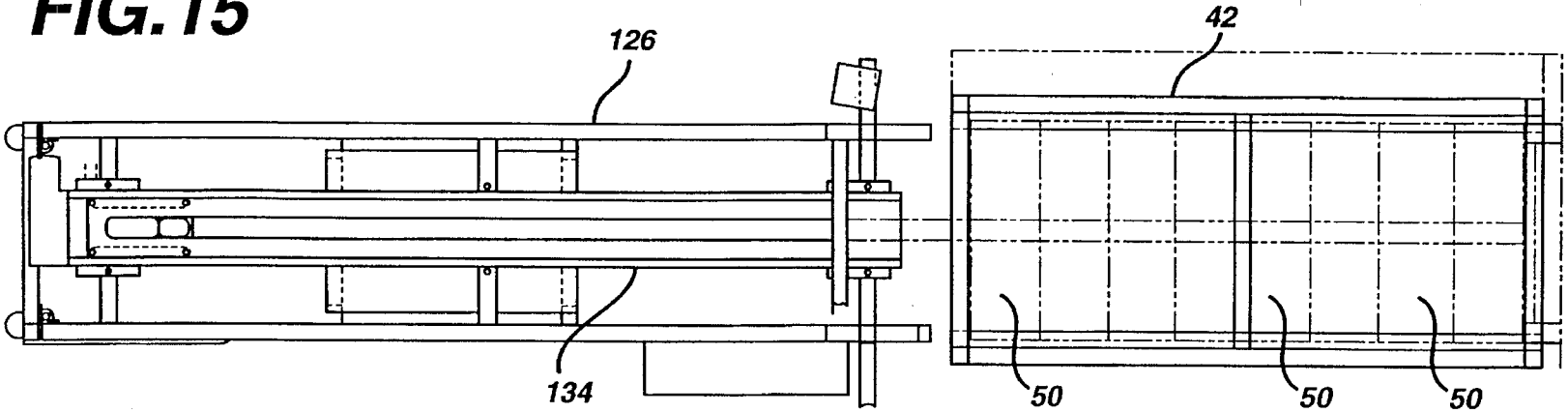
FIG. 15 is a top plan view of FIG. 14.

Reverting specifically to FIGS. 1, 6 and 14 of the drawings, a sterilization conveyor arrangement 30 of the apparatus 10 includes a first horizontal conveyor unit 32 along which racks 34, 42 each having a plurality of levels adapted to respectively receive and support in rows a number of upwardly-opening compartmented trays 50 adapted for the transport of arrays of blister packages 12.

As illustrated in FIG. 14, each of the racks 34 is basically a rectangular open-ended frame structure having horizontal supports 36 and 38 and uprights 40, and are adapted to be conveyed along the conveyor 32 to a first workstation A, with a first rack 34 having been previously filled with empty trays 50 each intended to respectively receive a quantity of arrays of blister packages 12. Located in front of the rack 34 at the workstation A is a further initially empty rack 42 which is adapted to receive trays 50 which have been filled with blister packages 12 at the workstation A, the latter of which is adapted to receive arrays from a blister package manufacturing and sealing facility.

The rack 34 at workstation A, and the rack 42 which is located ahead thereof are both positioned on respective lifting devices 52, 54, each having foldable scissors-type legs 56, 58, and which may be pneumatically operated and which are designed to index each of the racks 34, 42 vertically upwardly and downwardly by one tray level as required during the tray unloading, tray filling, and tray loading procedure at workstation A of the apparatus 10.

Figure 7:
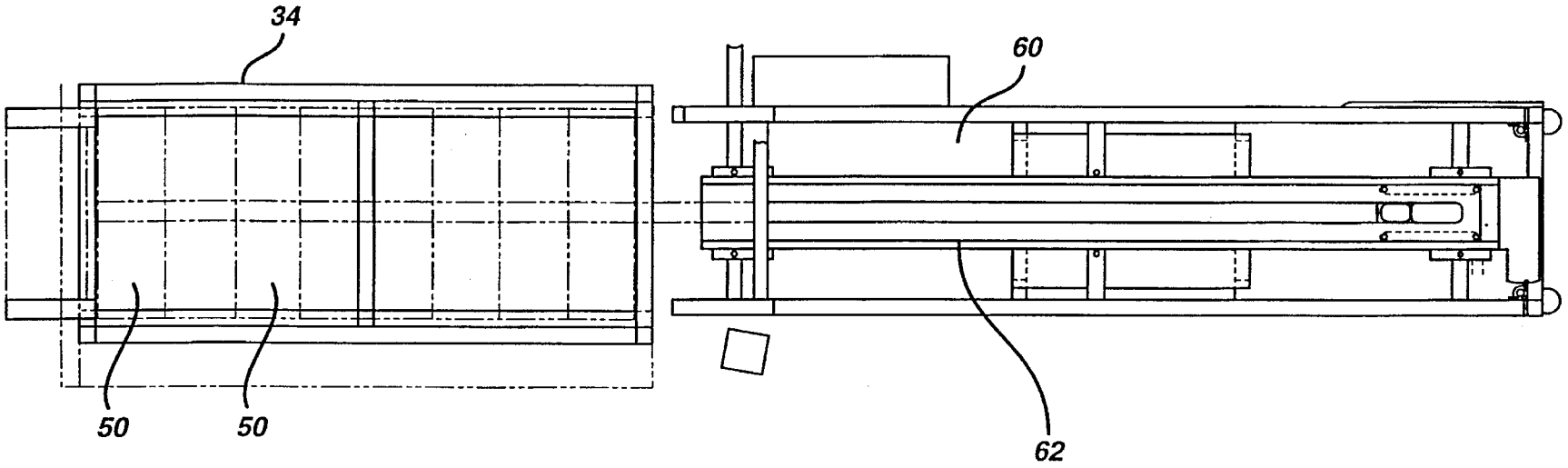
FIG. 7 is a top plan view of a rack unloader.
Figure 8:
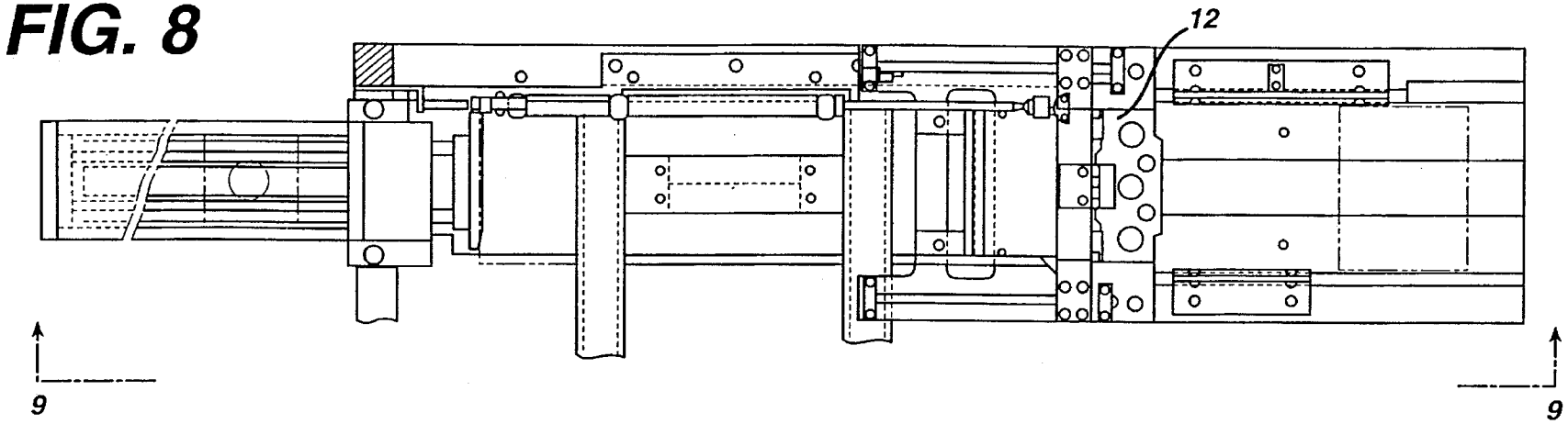
FIG. 8 is a top plan view of a tray loading workstation.
Figure 9:
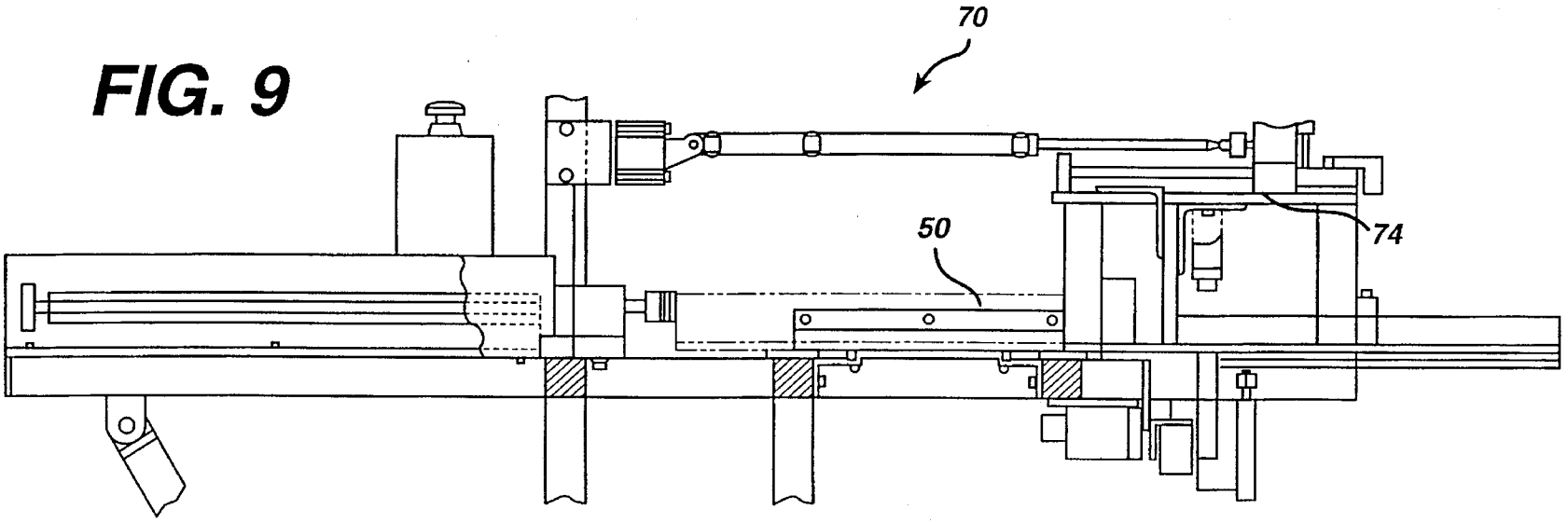
FIG. 9 is a side elevational sectional view, taken along line 9—9 in FIG. 8.

For that purpose, the apparatus 10 is provided with a first rack unloader 60 at workstation A including a horizontal pusher 62, as shown in FIGS. 6 and 7, which is adapted to apply a pushing action against one of the adjacently located trays 50 in an aligned level of rack 34 so as to cause a tray 50 at the opposite end of that particular row of trays in the rack 30 to be slid of the rack 34 onto a tray loading arrangement 70, as illustrated in FIGS. 8 and 9 of the drawings, for sequentially filling each respective unloaded tray 50 with arrays of blister packages 12.

The tray loading arrangement 70 at workstation A includes a vacuum-actuated array-gripping device 72 for placing successive arrays of blister packages 12 on a conveyor surface 74 for transporting the arrays 12 towards a vertical chute 76. This enables each array 12 to slide downwardly with the chute under the effect of gravity or its own weight to be able to drop into a tray 50 located below the lower discharge end 78 of chute 76.

Figure 10:
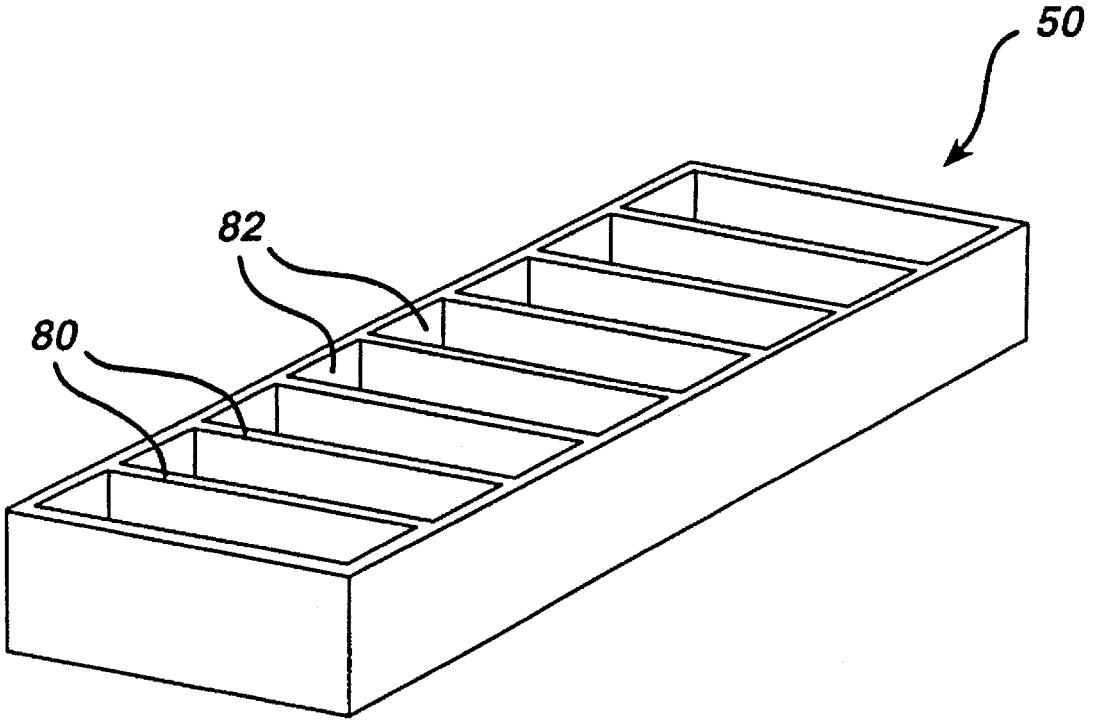
FIG. 10 is a perspective view of a typical tray for the receipt of arrays of blister packages.

The arrays of blister packages 12 are filled into the tray 50 located at tray loading arrangement 70, whereby the tray 50, as shown in FIG. 10, consists of a rectangular upwardly-opening box-like structure having a plurality of vertical partitions 80 forming parallel compartments 82 therebetween, into each of which one of the arrays of blister packages 12 is fed from the chute 76. The arrays 12 are filled into each successive compartment 82 between adjacent partitions so as the tray 50 is indexed forwardly by a suitable pusher device 84 towards the forwardly located rack 42 so as to be ultimately in alignment with one level thereof. As each tray 150 is filled with arrays of blister packages 12, upon each compartment 82 having been filled with an array 12 a pusher element 88 as shown in FIG. 1, will slide the tray into the therewith aligned level of the rack 42 associated therewith, while a subsequent empty tray 50 unloaded from rack 34 is advanced to tray loading arrangement 70 so as to provide a succession of array-filled trays 50 to be conducted into and fill each level of rack 42. Upon the level having been filled with trays 50 each containing a specified quantity of arrays of blister packages; for example forty-two arrays 12 in compartments 82, the previously lifted racks 34, 42 which were initially fully raised by the lifting devices 52, 54, are each indexed downwardly by one tray-supporting level so as to enable the next higher level or row of rack 42 to be filled with trays 50 containing arrays of blister packages 12. This sequence of operation is repeated until the loaded tray-filled rack 42 is transported onto a further conveyor 90 upon reaching its fully loaded lowermost position, and then laterally moved relative to conveyor 32 along the conveyor 90 towards and a sterilization chamber 92 at a workstation B.

At that time, the now empty rack 34 from which the empty trays 50 have been unloaded (so as to be filled with arrays 12 at arrangement 70 and then inserted into rack 42) is moved forwardly on conveyor into the tray loading position previously occupied by rack 42 at workstation A, and a subsequent rack containing empty trays 50 is advanced along the conveyor 32 into position in alignment with the rack unloader 60 wile raised into its highest position by lifter 52, while the rack 24 ahead thereof is also raised by lifting device 54, so as to enable the tray loading sequence to be repeated.

Figure 11:
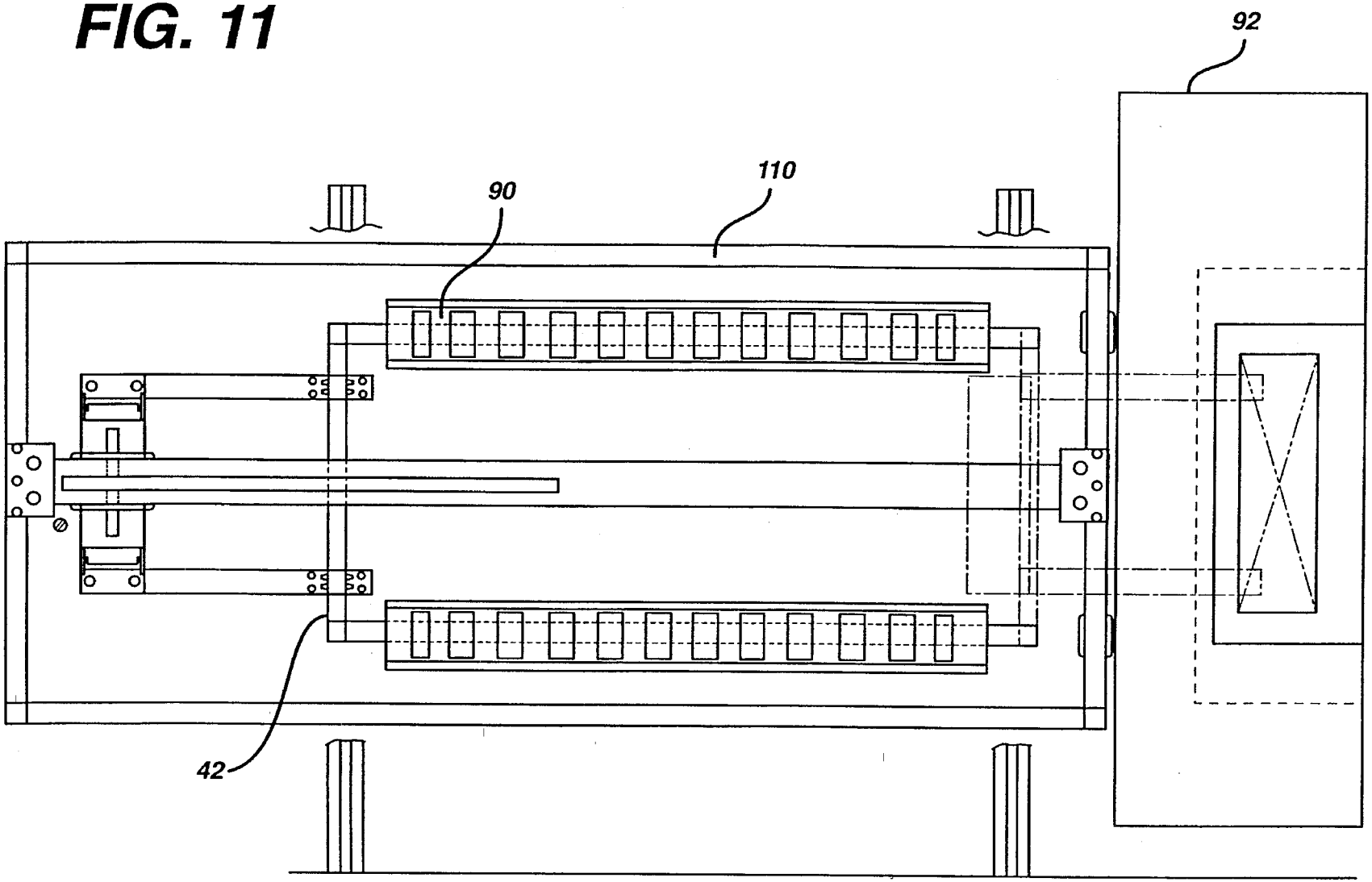
FIG. 11 is a top plan view of a conveyor segment for transporting racks carrying array-filled trays towards a sterilization chamber.
Figure 12:
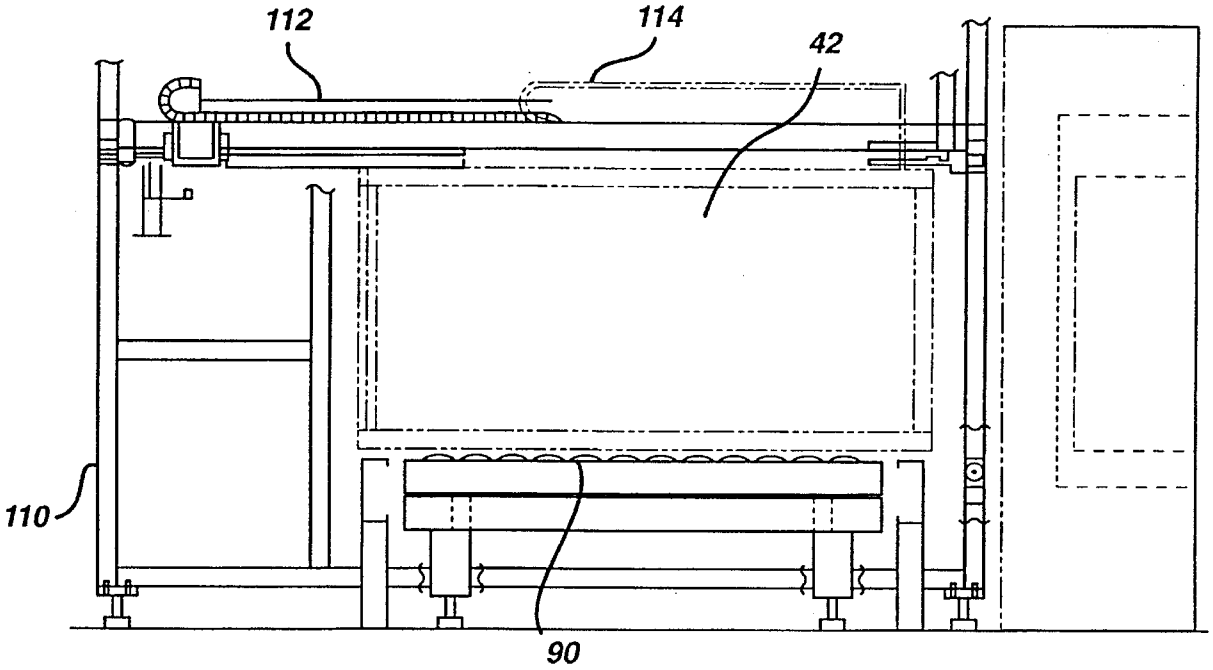
FIGS. 12 and 13 are, respectively, side and end elevational views of an arrangement for drawing racks into and out from the sterilization chamber.
Figure 13:
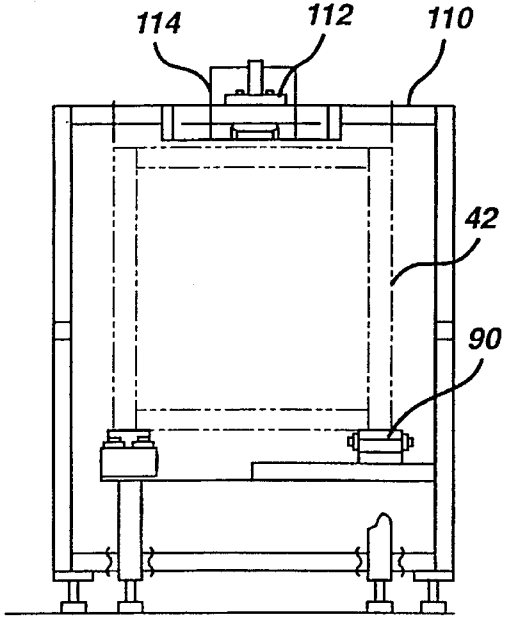

As the rack 42 containing the trays 50 filled with arrays of blister packages 12 is conveyed on the conveyor 90 into position in front of sterilization chamber 92, as shown in FIGS. 11 through 13 of the drawings, the rack 42 is located beneath a frame structure 110 straddling the sides thereof and extending above its uppermost level or upper frame. A hook-like gripping finger 112 which is attached to a retractable and extendable belt member 114 is adapted to engage the upper frame structure of rack 42 distant from the sterilization chamber 92. A drive unit (not shown) is adapted to retract the belt member 114, thereby causing the gripping finger 112 to draw the rack 42 into the sterilization chamber 92, and then to release from the rack 42 so as to enable the chamber to sealingly close and commence sterilizing operation on the contents of the arrays 12 located therein.

Upon the completion of the sterilization cycle, the rack 42 with the sterilized trays 50 of arrays of blister packages 12 is then pulled out of the chamber 92 by means of the gripping finger 112 engaging the upper edge of the framework of the rack with extension of the conveyor belt 114 so as to position the rack 42 in operative connection with a further conveyor 120 leading towards a secondary packaging or cartoning workstation C.

As the rack 42 containing the sterilized trays 50 with the arrays of blister packages 12 is advanced to be positioned adjacent a secondary packaging machine 120 at workstation C it is raised by a lifting device 122 similar to device 52 into the highest position so that the lowermost row of trays 50 in rack 42 is in horizontal alignment with a rack unloader 126 having a pusher arm 128, and which is similar to previously discussed rack unloader 60 both as to structure and function. Ahead of rack 42 is another rack 34 which has been previously unloaded and which is now in an empty condition and which is also in a fully raised position by means of a lifting device 130 of the type previously described, as shown in FIG. 1.

Figure 17:
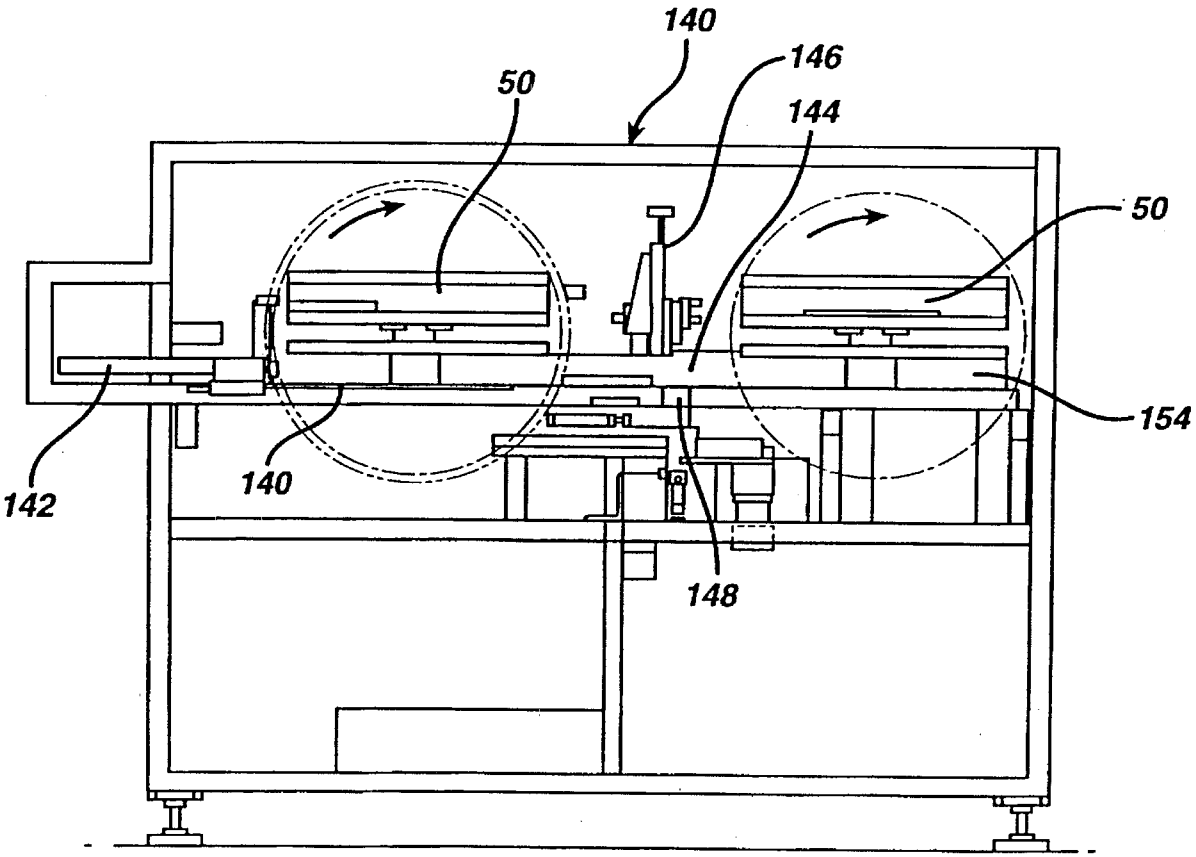
FIG. 17 and 18 are, respectively, side and end views of the tray unloading and orienting arrangement for the cartoning machine.
Figure 18:
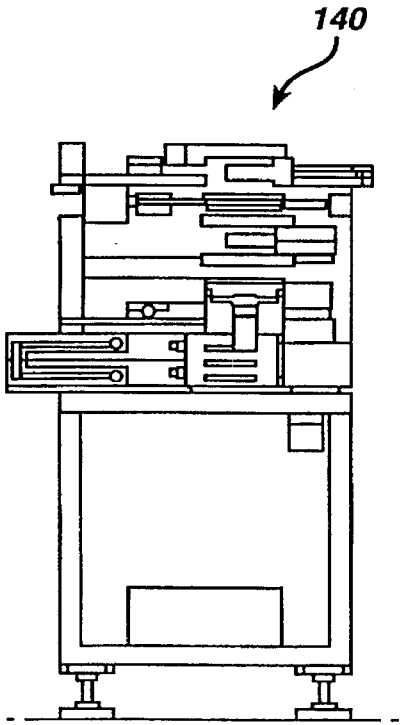

At that location, rack unloader 126, which, as mentioned, in structural and operational principle is identical or similar to the rack unloader 60 employed at workstation A, causes a pusher 134 to slide a fully loaded tray 50 containing the sterilized arrays of blister packages 12 onto an unloader device 140, as shown in FIG. 17 where the tray 50 is rotatably inverted 180°, such that the openings of each of the spaces or compartments 82 containing the sterilized arrays 12 face downwardly, although the latter are prevented from falling out of the tray 50 by means of a retaining plate member 140 positioned therebeneath.

The inverted tray 50 is then indexed forwardly by a pusher cylinder 142 by a distance of two adjacent compartment widths so as to enable two adjacent arrays 12 to fall downwardly into a chute 144, such downward displacing movement being aided by a vertical pusher 146 engaging simultaneously into two openings (not shown) formed in the bottom of each compartment 82 the tray and in alignment with each compartment containing an array of blister packages. The chute 144 is configured so as to cause the two falling arrays 12 to pass on opposite sides of a guide 146 and with a trough bottom 148 configured so that the arrays 12 assume a horizontal position inverted relative to each other in interleaved pairs, such as shown in FIG. 3 of the drawings.

Figure 16:
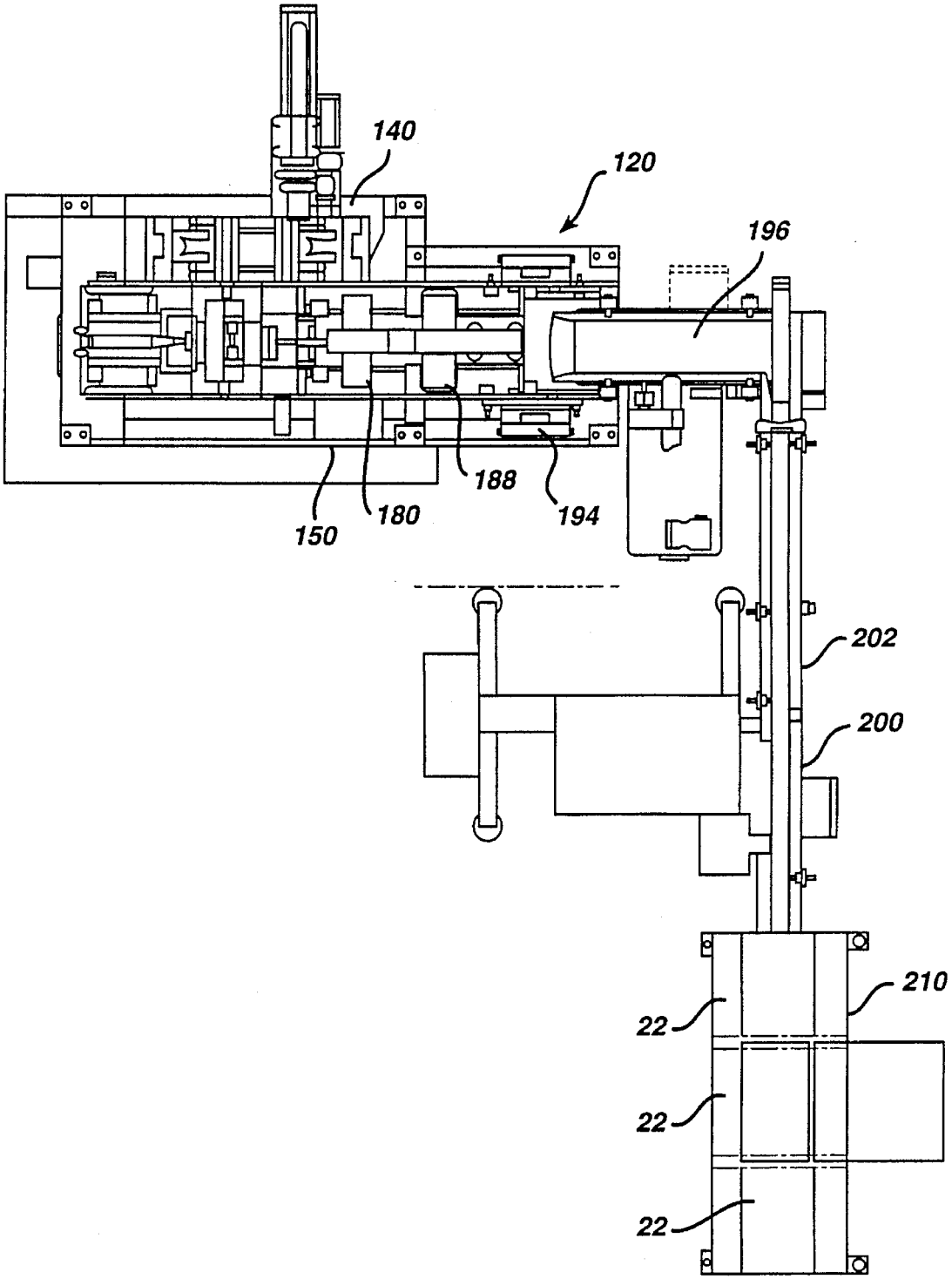
FIG. 16 is a schematic top plan view of a cartoning machine for the sterilized arrays of blister packages.

Upon a predetermined number of pairs of arrays of blister packages 12 being superimposed on each other, for example, such three pairs of arrays for a total of 30 blister packages, a pusher member will advance the superimposed arrays of blister packages towards a conveyor leading towards the generally diagrammatically illustrated secondary packaging or cartoning machine 150 at workstation C; having reference to FIG. 16 of the drawings.

As each inverted tray 50 is fully emptied of sterilized arrays 12, the rack 50 is advanced to a rack-loading arrangement 154, whereby the empty tray 50 is again rotated 180° into its original upwardly-opening position, and a pusher arm 156 is adapted to slide the empty tray 50 into the therewith aligned level of the empty rack 34 located adjacent thereto. This procedure is repeated until the level of the empty rack 34 is filled with empty trays 50 whereupon the rack is indexed downwardly by one further level through actuation of the lifting device 130 on which it is supported. Concurrently, the rack 42 which has the array-filled trays 50 unloaded therefrom is also indexed downwardly by its lifting device 122 so as to enable the subsequent higher level of array-filled trays 50 to be sequentially pushed outwardly by the rack unloader 126 towards the now vacant tray inverting mechanism.

This cycle of operation is repeated until the previously empty forward located rack 34 is filled with empty trays 50, and then advanced by conveyor system 160 towards the workstation A so as to be in readiness for repeating the previously described sequence of operation.

As shown in detail in FIG. 6, this represents the view taken along line 6—6 in FIG. 1, shown on a somewhat enlarged scale, and illustrating each of the racks 34, 42 at workstations A and C in their fully elevated or raised positions on the respective lifting devices associated therewith.

Hereby, at workstation A, the rack 34 is shown in the process of being unloaded by the pusher of the rack unloading device, while another rack in its elevated position is shown in readiness for being unloaded proximity with the secondary packaging or cartoning machine.

Upon the rack 42 being fully loaded at workstation A with trays 50 containing arrays of blister packages 12, or conversely, the rack 34 being filled with empty trays at workstation C, the lifting device for the racks are in their lowermost positions, as shown by the phantom lines at each location, and the racks are then adapted to be conveyed along the horizontal conveyor system into their respective further operative positions or locations.

Reverting to the secondary packaging or cartoning machine 150, the latter is shown in FIG. 16, and is as detailed hereinbelow.

Figure 5:
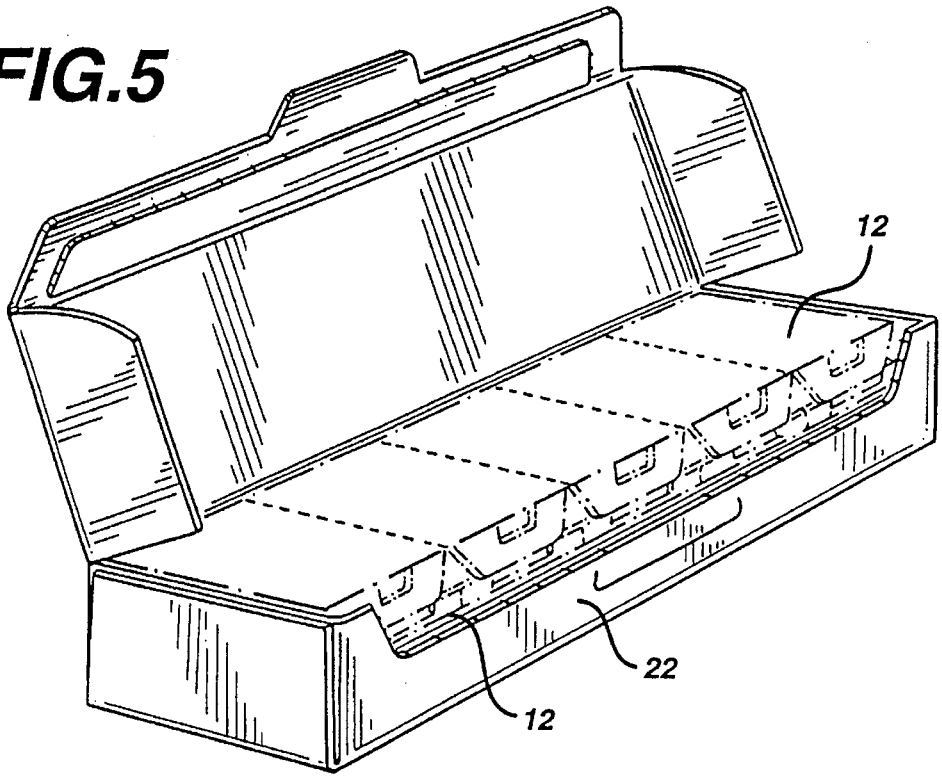
FIG. 5 is a perspective view of the carton in use, shown with the cover having been opened to enable access to the contents of the carton.

As is illustrated in the plan view of FIG. 16, the secondary packaging machine or cartoning arrangement 150 includes a series of conveyor sections, and also includes a vertical chute structure 170 containing a supply of open-ended but flat-folded or lay flat cartons 22 of the type illustrated in FIG. 3 through 5 of the drawings, with the ends of the carton being in an opened condition. This particular chute structure and carton feed arrangement is illustrated more clearly in the detail drawing of FIG. 19.

Adjacent to but spaced from the vertical chute structure 170 containing the open-ended lay flat cartons 22 is the tray unloading workstation C.

Figure 19:
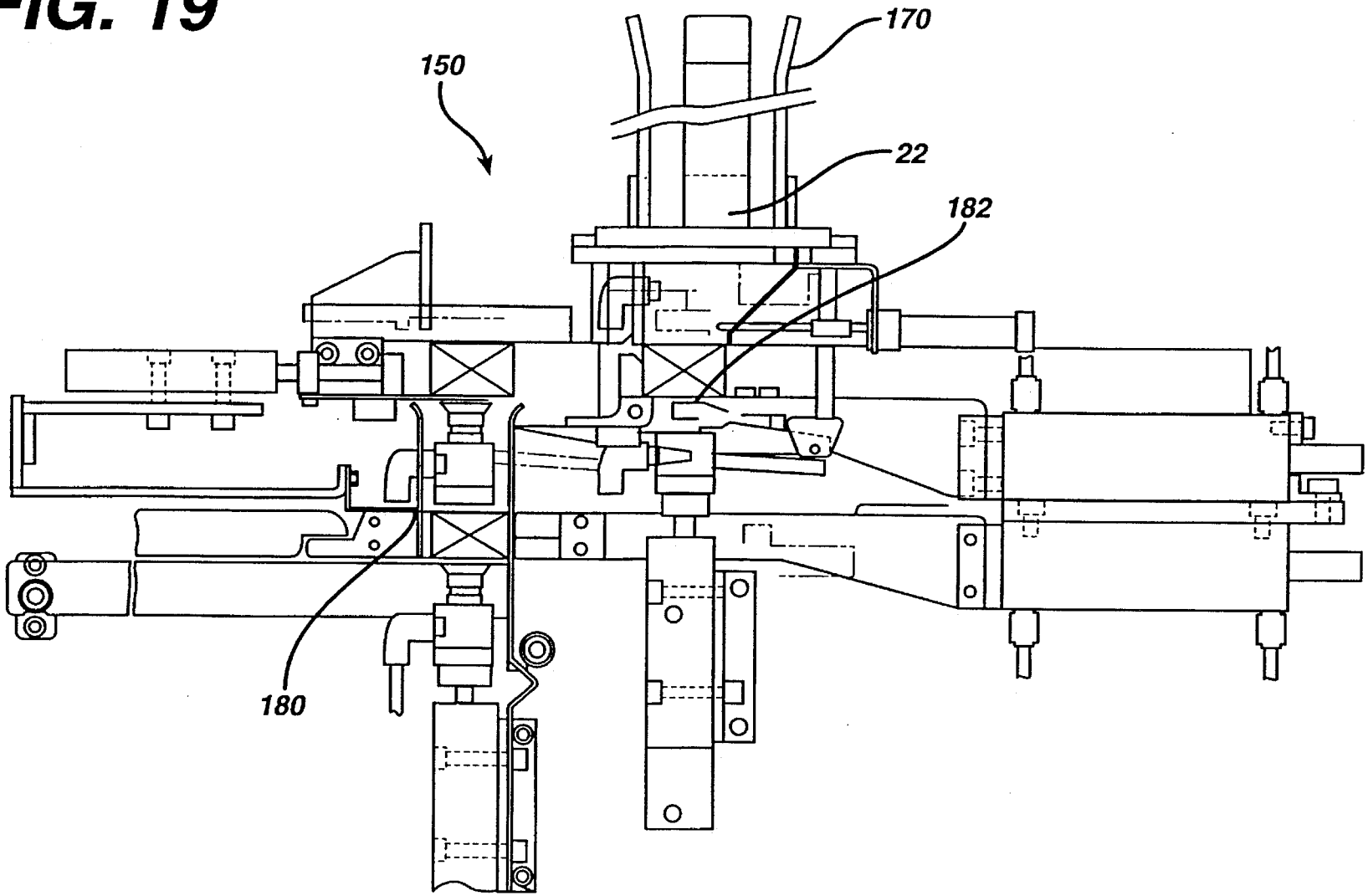
FIG. 19 illustrates, in elevation, a schematic detail of the cartoning machine of FIG. 16.

A pusher element advances the six arrays 12, or in effect, three interleaved array pairs at the bottom of trough 148 shown in FIG. 17 towards a further conveyor 180 which is essentially offset but at the same level as the lower end of the chute structure 170 containing the stack of flattened cartons 22. Thereafter, a carton 22 which is opened by a pneumatic pulling element 182, as illustrated in FIG. 19 into its fully opened position as shown in phantom lines is drawn downwardly and indexed into a chute or conveyor 186 into alignment with an open end of the carton, and is then pushed or slid axially into the carton 22.

The carton 22 with the paired arrays 12 contained therein is then advanced along a further conveyor run 188 which includes mechanisms causing the end and side flaps of the carton to be folded inwardly into closed position, and thereafter is transferred to a further conveyor for upward movement through a gluing apparatus 194 which causes the glue flaps to be folded down into glued and sealed condition, thereby completing the closed and sealed carton structure.

From there, the carton 22 is conveyed to a labeling station wherein a jet printer 196 imprints information on the carton relative to the characteristics of the contact lenses contained in the blister packages of the arrays 12, and then is conveyed to a further station for applying a bar code strip to the carton surface pertaining to other information which may be required.

As illustrated in the drawing FIG. 16, the sealed carton 22 is then positioned on a horizontal conveyor run 202 so as to pass a weight checking station 200 which will provide information over the correct weight of the filled carton 22 containing the arrays of blister packages 12, indicative that the appropriate amount of arrays is contained therein.

The conveyor run 202 then advances the closed bar code labeled, imprinted and weight checked carton towards an accumulating area 210 in which an entire sequence of cartons may be collected and manually placed into a larger box or container for further storage or warehousing.

The foregoing procedure is implemented whereby, for instance, each tray 50 may possess 42 compartments each adapted to house, respectively one array of blister packages 12, and with each rack 34, 42 being constructed with eight vertically stacked levels or rows adapted to each receive eight trays 50 in contiguous side-by-side relationship; in effect, for a total of sixty-four (64) trays 50 each containing forty-two (42) arrays of blister packages 12 for simultaneous conveyance into the sterilizing chamber 92.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention therein disclosed as hereinafter claimed.

What is claimed:

1. An apparatus for the sterilization of arrays of interconnected blister packages each containing a contact lens in a sterile environment; comprising:

(a) a plurality of racks transportable between a series of workstations;

(b) a conveyor arrangement for transporting said racks between said series of workstations;

(c) a plurality of trays for receiving said arrays of blister packages, each of said trays being selectively loadable into and unloadable from said racks;

(d) means positioning first and second of said racks at a first said workstation, said first rack being empty and said second rack containing a plurality of said trays in an empty condition;

(e) unloading means at said first workstation for unloading individual of said empty trays in predetermined sequence from said second rack;

(f) means at said first workstation for filling each said unloaded empty tray with a plurality of said arrays advancing the array-filled tray into alignment with said empty first rack and loading each said tray into said first rack in predetermined sequence;

(g) conveyor means advancing said tray-filled first rack towards a second said workstation comprising a sterilizing chamber;

(h) means engaging said first rack at said second workstation for conveying said first rack into said sterilizing chamber, and said engaging means withdrawing said first rack from said sterilizing chamber subsequent to sterilizing of the arrays in said trays; and (i) further conveyor means advancing said first rack from said sterilizing workstation to a third workstation for unloading said trays from said first rack and removing the sterilized arrays of blister packages therefrom.

2. An apparatus as claimed in claim 1, wherein each said tray comprises an upwardly opening box-like structure having a plurality of adjacent elongate compartments each adapted to receive respectively one said array of blister packages at said first workstation.

3. An apparatus as claimed in claim 2, wherein said filling means comprises a vacuum-assisted structure for lifting successive of said arrays and depositing said arrays into a chute communicating with successive of said compartments upon said tray being indexed forwardly at said first workstation.

4. An apparatus as claimed in claim 1, wherein pusher means loads each successive of said array-filled trays into said first rack.

5. An apparatus as claimed in claim 1, wherein said first and second racks each possess a plurality of vertically spaced levels each adapted to respectively support a plurality of said trays in contiguous positions.

6. An apparatus as claimed in claim 5, wherein lifting means at said first workstation support said first and second racks for indexed vertical displacement so as to facilitate unloading empty trays from successive levels of said second rack and concurrently loading array-filled trays into successive levels of said first rack.

7. An apparatus as claimed in claim 6, wherein said lifting means comprise pneumatically-actuated structures operatively associated with and supporting said first and second racks for incrementally raising and lowering said racks in alignment with the levels supporting the trays in each of said racks.

8. An apparatus as claimed in claim 1, wherein said unloading means for said empty trays at said first workstation comprises a horizontally displaceable pusher member engaging into said second rack and contacting one of said trays to slidingly unload a tray at the opposite end of said rack towards said tray filling means.

9. An apparatus as claimed in claim 1, wherein said means for engaging and conveying said rack into said sterilizing chamber comprises a gripping element engaging an upper edge of said rack distant from said sterilizing chamber; and retractable means for drawing said gripping element towards said sterilizing chamber so as to position said rack in said chamber and thereafter releasing said gripping element from said rack.

10. An apparatus as claimed in claim 9, wherein said gripping means withdraws said rack from said sterilizing chamber upon completion of a sterilization cycle.

11. An apparatus as claimed in claim 10, wherein conveyor means transports said first rack and sterilized arrays in said trays to a rack unloading station for transporting said trays to a cartoning arrangement.

12. An apparatus as claimed in claim 10, wherein said rack unloading station comprises pusher means for successively sliding individual trays from said first rack onto a platform; means for inverting said tray; indexing means for advancing said inverted tray so as to dispense pairs of arrays therefrom.

13. An apparatus as claimed in claim 12, wherein a downwardly extending chute receives said pairs of array; means at an outlet of said chute for orienting said pairs of arrays into interleaved pairs, and collecting predetermined quantities of said interleaved pairs of arrays.

14. An apparatus as claimed in claim 12, wherein said cartoning arrangement comprises a chute for dispensing cartons having open ends; and conveyor means for transporting predetermined quantities of pairs of said arrays into successive of said cartons.

15. An apparatus as claimed in claim 14, wherein conveyor means transports said cartons and arrays contained therein through apparatus for closing the end flaps of said cartons.

16. An apparatus as claimed in claim 15, wherein further conveyor means transports said cartons through a glueing device for sealing closing glue flaps on said cartons so as to form a sealed carton structure.

17. An apparatus as claimed in claim 16, wherein a jet ink printer imprints information on said cartons.

18. An apparatus as claimed in claim 16, wherein labeling means adheres strips of bar coded information to said cartons.

19. An apparatus as claimed in claim 16, wherein weight checking means weighs each said carton and the contents therein.

20. An apparatus as claimed in claim 1, wherein said sterilization chamber comprises an autoclave.

21. An apparatus as claimed in claim 16, wherein conveyor means transports said cartons to an accumulating area for collecting and boxing a plurality of said cartons.

22. A method for the sterilization of arrays of interconnected blister packages each containing a contact lens in a sterile environment; said method comprising:

(a) transporting a plurality of racks between a series of workstations;

(b) a plurality of trays for receiving said arrays of blister packages being selectively loaded into and unloaded from said racks;

(c) positioning first and second of said racks at a first said workstation, said first rack being empty and said second rack containing a plurality of said trays in an empty condition;

(d) unloading at said first workstation individual of said empty trays in predetermined sequence from said second rack;

(e) filling at said first workstation each said unloaded empty tray with a plurality of said arrays advancing the array-filled tray into alignment with said empty first rack and loading each said tray into said first rack in predetermined sequence;

(f) advancing said tray-filled first rack towards a second said workstation comprising a sterilizing chamber;

(g) engaging said first rack at said second workstation for conveying said first rack into said sterilizing chamber, and withdrawing said rack from said sterilizing chamber subsequent to sterilizing of the arrays in said trays; and (h) further advancing said first rack from said sterilizing workstation to a third workstation for unloading said trays from said first rack and removing the sterilized arrays of blister packages therefrom.

23. A method as claimed in claim 22, wherein each said tray comprises an upwardly opening box-like structure having a plurality of adjacent elongate compartments each adapted to receive respectively one said array of blister packages at said first workstation.

24. A method as claimed in claim 23, wherein said filling comprises actuating a vacuum-assisted structure for lifting successive of said arrays and depositing said arrays into a chute communicating with successive of said compartments upon said tray being indexed forwardly at said first workstation.

25. A method as claimed in claim 22, wherein successive of said array-filled trays are each loaded into said first rack.

26. A method as claimed in claim 22, wherein said first and second racks each possess a plurality of vertically spaced levels each adapted to respectively support a plurality of said trays in contiguous positions.

27. A method as claimed in claim 26, wherein at said first workstation said first and second racks are activated for indexed vertical displacement so as to facilitate unloading empty trays from successive levels of said second rack and concurrently loading array-filled trays into successive levels of said first rack.

28. A method as claimed in claim 27, wherein said lifting comprises activating pneumatically-actuated structures operatively associated with and supporting said first and second racks for incrementally raising and lowering said racks in alignment with the levels supporting the trays in each of said racks.

29. A method as claimed in claim 22, wherein the unloading of said empty trays at said first workstation comprises operating a horizontally displaceable pusher member for engaging into said second rack and contacting one of said trays to slidingly unload a tray at the opposite end of said second rack.

30. A method as claimed in claim 22, wherein engaging and conveying said first rack into said sterilizing chamber comprises a gripping element engaging an upper edge of said first rack distant from said sterilizing chamber; and drawing said gripping element towards said sterilizing chamber so as to position said first rack in said chamber and thereafter releasing said gripping element from said rack.

31. A method as claimed in claim 30, wherein said first rack is withdrawn from said sterilizing chamber upon completion of a sterilization cycle.

32. A method as claimed in claim 31, wherein said first rack and sterilized arrays in said trays are transported to a rack unloading station for transporting said trays to a cartoning arrangement.

33. A method as claimed in claim 31, wherein said rack unloading station comprises successively sliding individual trays from said first rack onto a platform; inverting said tray; and indexed advance of said inverted tray so as to dispense pairs of arrays therefrom.

34. A method as claimed in claim 33, wherein a downwardly extending chute receives said pairs of array; orienting said pairs of arrays into interleaved pairs, and collecting predetermined quantities of said interleaved pairs of arrays.

35. A method as claimed in claim 33, wherein said cartoning arrangement comprises dispensing cartons having open ends; and transporting predetermined quantities of pairs of said arrays into successive of said cartons.

36. A method as claimed in claim 35, wherein said cartons and arrays contained therein are transported through apparatus for closing the end flaps of said cartons.

37. A method as claimed in claim 36, wherein said cartons are conveyed through a glueing device for sealing closing glue flaps on said cartons so as to form a sealed carton structure.

38. A method as claimed in claim 37, wherein a jet ink printer imprints information on said cartons.

39. A method as claimed in claim 37, wherein labeling means adheres strips of bar coded information to said cartons.

40. A method as claimed in claim 37, wherein weight checking means weighs each said carton and the contents therein.

41. A method as claimed in claim 22, wherein said sterilization chamber comprises an autoclave.

42. A method as claimed in claim 37, wherein said cartons are transported to an accumulating area for collecting and boxing a plurality of said cartons.

* * * * *